US010022283B2

(12) United States Patent
Lawless

(10) Patent No.: US 10,022,283 B2
(45) Date of Patent: Jul. 17, 2018

(54) PLATFORM FOR PATIENT CONVEYING EQUIPMENT

(76) Inventor: Kevin Wilson Lawless, Hilton Head Island, SC (US)

( * ) Notice: Subject to any disclaimer, the term of this patent is extended or adjusted under 35 U.S.C. 154(b) by 0 days.

(21) Appl. No.: 13/211,006

(22) Filed: Aug. 16, 2011

(65) Prior Publication Data

US 2012/0043443 A1 Feb. 23, 2012

Related U.S. Application Data

(60) Provisional application No. 61/374,308, filed on Aug. 17, 2010.

(51) Int. Cl.

| | |
|---|---|
| ***A61G 1/02*** | (2006.01) |
| ***A61G 7/10*** | (2006.01) |
| ***A61G 7/053*** | (2006.01) |
| *A61G 7/05* | (2006.01) |
| *A61G 1/04* | (2006.01) |
| *A61G 7/075* | (2006.01) |
| *A61G 15/08* | (2006.01) |

(52) U.S. Cl.

CPC ..... *A61G 1/02* (2013.01); *A61G 1/0293* (2013.01); *A61G 7/053* (2013.01); *A61G 7/1046* (2013.01); *A61G 1/04* (2013.01); *A61G 7/05* (2013.01); *A61G 7/0755* (2013.01); *A61G 7/1057* (2013.01); *A61G 15/08* (2013.01)

(58) Field of Classification Search

CPC ... A47D 5/00; A47D 7/04; A47D 9/00; A61G 13/10; A61G 13/0018; A61G 13/125; A61G 7/1046; A61G 7/053; A61G 7/1057; A61G 1/04; A61G 7/0755; A61G 7/05; A61G 1/0293; A61G 1/02; A47B 23/02; A47B 1/05; A47B 1/10

USPC ..... 5/507.1, 661, 662, 95; 280/166, 163, 280/164.1, 47.131; 248/225.11, 658, 248/346.06, 346.11, 657, 669, 673, 678, 248/121, 918, 118, 202.1, 913; 361/679.11, 679.08; 269/249

See application file for complete search history.

(56) References Cited

U.S. PATENT DOCUMENTS 1,345,668 A * 7/1920 Fairchild ..... B61D 23/02 105/447
1,404,207 A * 1/1922 Lenz ..... A61G 7/00 5/185
1,560,887 A * 11/1925 Watson ..... A47B 88/10 16/100
1,930,882 A * 10/1933 McRae ..... A47B 23/02 108/143
2,524,971 A * 10/1950 Gray ..... E06C 1/397 182/106
2,532,705 A * 12/1950 Freund ..... A47C 7/506 5/624
2,565,784 A * 8/1951 Sheean ..... 312/286
(Continued)

*Primary Examiner* — Stanton L Krycinski
*Assistant Examiner* — Taylor L Morris
(74) *Attorney, Agent, or Firm* — Reising Ethington P.C.

(57) ABSTRACT

A platform adapted to be attached to a piece of conveying equipment such as a gurney. The platform includes a base defining a cavity. The platform further includes a coupling receiver mounted on the top of the base. The coupling receiver receives a support structure of the conveying equipment and releasably secures the platform to the conveying equipment. A platform member is slideably received within the cavity and is moveable between extended and non-extended positions.

16 Claims, 7 Drawing Sheets

(56) References Cited

U.S. PATENT DOCUMENTS 2,644,961 A * 7/1953 Hillenbrand ..... A61G 7/053 5/507.1
2,659,902 A * 11/1953 Fitzgerald ..... A61G 7/053 182/39
2,665,432 A * 1/1954 Butler ..... A61G 7/1026 5/88.1
2,712,484 A * 7/1955 Adolphson ..... A61G 13/0018 108/38
2,848,723 A * 8/1958 Arcand ..... A61G 7/1019 5/85.1
2,941,215 A * 6/1960 Johnson ..... A47C 16/02 5/507.1
3,049,725 A * 8/1962 Bovre ..... A61G 7/1015 5/86.1
3,329,978 A * 7/1967 Porter ..... A61G 7/103 5/81.1 R
3,427,666 A * 2/1969 Saxe ..... A47D 5/00 312/314
3,535,508 A * 10/1970 Warshauer ..... 362/396
3,606,302 A * 9/1971 Allard ..... A61G 1/0237 269/16
3,814,414 A * 6/1974 Chapa ..... 5/601
3,962,736 A * 6/1976 Fedele ..... A61G 1/003 5/81.1 HS
4,183,596 A * 1/1980 Greene et al. ..... 312/333
4,190,280 A * 2/1980 Donohoe ..... A61G 1/04 280/32.7
4,222,136 A * 9/1980 Valentino ..... A47C 21/00 182/92
4,489,449 A * 12/1984 Failor ..... A61G 7/00 5/83.1
4,524,475 A * 6/1985 Valentino ..... A47C 21/00 182/91
4,564,965 A * 1/1986 Goodwin ..... A61G 7/05746 5/406
4,598,956 A * 7/1986 Teramachi ..... 384/45
4,644,594 A * 2/1987 Johnson ..... A61G 1/003 5/428
4,676,687 A * 6/1987 Koffler ..... 403/386
4,700,417 A * 10/1987 McGovern ..... A61G 7/1019 5/81.1 T
4,776,605 A * 10/1988 Hathcock ..... A61G 1/0237 280/250.1
4,915,437 A * 4/1990 Cherry ..... 296/37.6
4,964,182 A * 10/1990 Schmerler ..... A47K 17/026 135/67
4,968,013 A * 11/1990 Kuck ..... 5/600
5,005,667 A * 4/1991 Anderson ..... 182/15
5,065,464 A * 11/1991 Blanchard ..... A61G 7/1028 180/125
5,233,710 A * 8/1993 Bernard ..... A47D 5/00 5/424
5,375,962 A * 12/1994 Kempf ..... 414/541
5,384,925 A * 1/1995 Vail ..... A47C 29/006 5/310
5,406,777 A * 4/1995 Porto ..... B65B 67/1238 248/97
5,422,928 A * 6/1995 Payne ..... 378/177
5,446,934 A * 9/1995 Frazier ..... A61G 11/00 5/421
5,570,483 A * 11/1996 Williamson ..... A61G 1/0293 177/144
5,570,988 A * 11/1996 Gallaway ..... B62B 5/0003 414/343
5,617,072 A * 4/1997 McNeal ..... 340/431
5,845,351 A * 12/1998 Berta et al. ..... 5/626
6,086,176 A * 7/2000 Aoyama ..... 312/286
6,098,935 A * 8/2000 Kaplan et al. ..... 248/118.1
6,178,575 B1 * 1/2001 Harada ..... A61G 7/08 180/11
6,289,536 B1 * 9/2001 Betson ..... A61G 5/00 5/613
6,378,148 B1 * 4/2002 Votel ..... A61G 7/1015 5/81.1 HS
6,526,609 B2 * 3/2003 Wong ..... 5/601
6,568,008 B2 * 5/2003 Siepmann et al. ..... 5/617
6,598,844 B2 * 7/2003 Barber ..... 248/284.1
6,662,392 B2 * 12/2003 Heimbrock ..... A61G 7/0507 5/507.1
6,685,204 B1 * 2/2004 Hehr ..... 280/166
6,766,547 B1 * 7/2004 Lagassey ..... A61G 1/0567 5/507.1
6,880,843 B1 * 4/2005 Greer, Jr. ..... 280/166
6,907,625 B2 * 6/2005 Nomura ..... A61G 7/053 5/617
7,007,314 B2 * 3/2006 Courouzos ..... A47K 3/074 4/572.1
7,168,722 B1 * 1/2007 Piotrowski et al. ..... 280/166
7,386,899 B2 * 6/2008 Smith ..... 5/507.1
7,513,000 B2 * 4/2009 DeBraal et al. ..... 5/600
7,987,538 B1 * 8/2011 Kimball ..... A47C 21/00 5/424
2002/0008184 A1 * 1/2002 Kania ..... B60P 3/40 248/500
2002/0179781 A1 * 12/2002 Timm ..... 248/118
2002/0195792 A1 * 12/2002 Hendrix ..... 280/164.1
2003/0116938 A1 * 6/2003 Shields et al. ..... 280/166
2006/0016939 A1 * 1/2006 Blackburn ..... 248/118
2007/0118990 A1 * 5/2007 Kuenzel ..... A61G 5/006 5/618
2009/0178203 A1 * 7/2009 Homan ..... A47D 5/006 5/655
2010/0199426 A1 * 8/2010 Long ..... A47D 7/04 5/100
2010/0264618 A1 * 10/2010 Agoncillo et al. ..... 280/166
2015/0005618 A1 * 1/2015 Dumoulin ..... A61B 5/0555 600/415

* cited by examiner

PLATFORM FOR PATIENT CONVEYING EQUIPMENT

CROSS-REFERENCE TO RELATED APPLICATION

This application claims the benefit of U.S. Provisional Application No. 61/374,308 filed Aug. 17, 2010, the content of which is incorporated herein by reference in its entirety.

FIELD OF THE INVENTION

The present invention relates generally relates to a platform for patient conveying equipment. More specifically, the present invention relates to a platform that can be used in conjunction with patient conveying equipment such as a gurney to aid in positioning of a medical worker relative to a patient.

BACKGROUND OF THE INVENTION SUMMARY OF THE INVENTION

Medical patient conveying equipment, such as cots, gurneys or carts typically has wheels for facilitating movement of patients on the equipment. The wheels typically are supported on the bottom of a frame which may be a fixed frame or a foldable frame. Such frames are well known.

Medical personnel, and particularly emergency medical personnel, such as EMS personnel, paramedics or the like often have to convey patients from one site to another, such as for example from a remote site to a vehicle such as an ambulance. Often, while the patient is being conveyed, medical personnel must perform various procedures on the patient. Current conveying equipment is not designed to allow the medical personnel to work on the patient without walking beside the conveying equipment at the same time the procedures are being performed. Further, often the position of the patient on the conveying equipment relative to the medical personnel provides may be a disadvantageous position for the medical personnel to perform a procedure on the patient. Often while the conveying equipment is in transit, the patient is at a height relatively higher that might be preferable to perform a procedure on the patient.

If medical personnel have difficulty performing a procedure because of position relative to the patient or the need to walk beside the conveying equipment, patient treatment may be compromised. Accordingly it may be desirable to provide a device that can more advantageously position medical personnel relative to a patient on the conveying equipment. It may also be desirable to provide a device that may reduce the need for medical personnel to walk next to such conveying equipment while a patient is being conveyed.

SUMMARY OF THE INVENTION

According to an embodiment, there is provided a platform adapted to be attached to a piece of conveying equipment. The platform comprises a base. A coupling receiver is disposed on the base and is capable of receiving at least a portion of the conveying equipment to releasably retain the base on the conveying equipment. The platform further comprises a platform member slideably retained on the base and moveable between a non-extended position and an extended position relative to the base.

According to an embodiment, there is provided a platform adapted to be attached to a piece of conveying equipment. The platform comprises a base comprising a top and bottom and defines a cavity. The cavity has first and second ends. The bottom includes a stop. The platform further includes a platform member disposed in the cavity and moveable between a non-extended position and an extended position relative to the cavity. The stop limits movement of the platform member. The platform further comprises a platform member locking mechanism selectively engageable with the platform member. The platform further comprises a coupling receiver disposed on the base and capable of receiving at least a portion of the conveying equipment to releasably retain the base on the conveying equipment.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
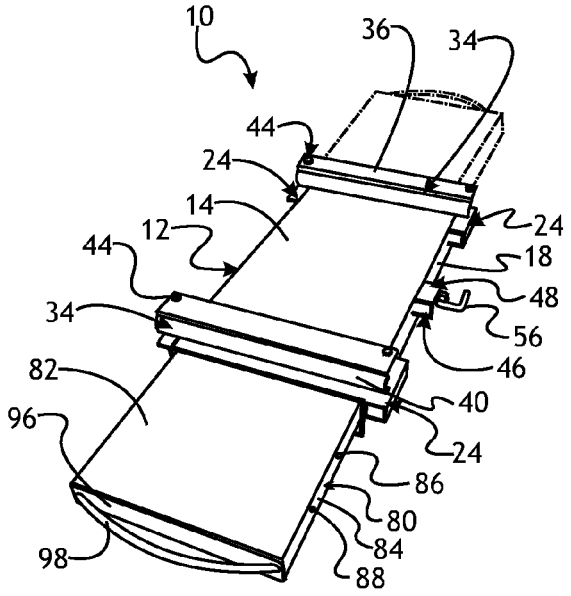
FIG. 1 is a perspective view of one embodiment.

A platform, particularly adapted for use in connection with patient conveying equipment, is generally shown at 10 in the Figures. The platform 10 may include a base, generally indicated at 12. In one embodiment, the base 12 includes a top 14 (best seen in FIG. 8) and a bottom 16 (best seen in FIG. 9). The top 14 may comprise a flat, generally rectangular top 14. The bottom 14 may also comprise a flat generally rectangular bottom 16. A pair of sides 18 and 20 may interconnect the top and bottom at the side edges of the top and bottom, respectively. In this manner a generally tubular structure is formed having a rectangular cross section and providing a cavity 22 between the top 14, bottom 16 and sides 18, 20. The cavity has first and second ends. The top 14, bottom 16 and sides 18, 20 may be made of any suitable material, including plastic, metal or composite material or combinations. In one embodiment, the top 14, bottom 16 and sides 18, 20 each comprise aluminum. In one embodiment, the base 12 may comprise a suitable mass to offset the moment created by medical service personnel using the platform 10 when the platform 10 is connected with the conveying equipment, generally indicated at 11. Further, the top, bottom and sides may take any suitable configuration.

The base 12 may further include one or more mounting flanges generally indicated at 24 disposed adjacent the top 14 and on the sidewalls 18, 20. In one embodiment four mounting flanges 24 may be used. The mounting flanges 24 may be disposed such that they provide a mounting plate 26 relatively even with the top 14 or the mounting plate 26 may be recessed below the top 14. Further, the mounting flanges 24 may or may not extend past the end edges of the top 14. In one embodiment the mounting flanges 24 may further include a side support wall depending from the mounting plate 26. A bottom support plate (not shown) may also be provided. In one embodiment the mounting flanges 24 may thus comprise the mounting plate 26, side support walls and bottom support plate which are formed into a generally tubular configuration having with a rectangular or square cross section. The mounting plate 26 may have an aperture 32 therethrough. The aperture is for receiving a locking mechanism such as a fastener as will be described below. Additionally, the bottom support plate (not shown) may have an aperture therethrough for receiving a fastener.

The mounting flanges 24 may be made of any suitable material, including plastic, metal or composite material or combinations. In one embodiment, the mounting flanges 24 comprise aluminum. The mounting flanges 24 may be secured to the sides 18, 20 in any suitable fashion. By way of non limiting example, the mounting flanges 24 may be welded or secured by fasteners, such as, but not limited to threaded fasteners or rivets to the sides 18, 20. It will be appreciated that any suitable manner of securing the mounting flange 24 to the base 12 is contemplated. While one embodiment shows the mounting flanges 24 secured to the sides 18, 20, it will be appreciated that the mounting flanges can be secured to any other structure on the base 12. Furthermore, the mounting flanges 24 may be eliminated in some embodiments (not shown).

In one embodiment, a coupling receiver, generally indicated at 34 may be disposed on the base 12. The coupling receiver 34 may be capable of receiving at least a portion of the conveying equipment to releasably retain the base 12 on the conveying equipment. The coupling receiver 34 can take any suitable configuration to allow the base to be releasably retained on the conveying equipment. In one embodiment, the coupling receiver 34 comprises a generally C-shaped member. The coupling receiver 34 may have a pair of space legs 36, 38 interconnected by arcuate portion 40. The legs 36, 38 and arcuate portion 40 may comprise one piece and form the generally C-shaped coupling receiver 34. Alternatively the coupling receiver 34 may be made of multiple parts. It will also be appreciated that the coupling receiver can take any suitable configuration so as to releasably retain the base 12 on the conveying equipment 11. The coupling receiver 34 may comprise any suitable material, including metal, plastic or composite material or combinations. In one embodiment, the coupling receiver 34 may comprise aluminum bar that is machine rolled into the generally C-shape member.

One leg 38 of the coupling receiver may be secured to the base 12. In one embodiment, the leg 38 is secured to the top 14 by welding the leg 38 to the top 14. It will be appreciated that the leg 38 can be secured to the top in any suitable manner, including but not limited to the use of fasteners or adhesives.

One leg 36 may extend further from the arcuate portion 40 than the leg 38. In one embodiment, the leg 36 extends sufficient to allow a portion of the conveying equipment to be retained between the leg 36 and the other leg 38 and the top 14. The leg 36 may include one or more apertures 42 for receiving one or more locking mechanisms, generally indicated at 44. The apertures 42 of the coupling receiver 34 may align with the apertures 32 of the mounting flanges 24 to receive the locking mechanism 44. This allows at least a portion of the conveying equipment to be placed into the coupling receiver 34 and the locking mechanism 44 can be used to releasably secure the base 12 to the conveying equipment.

In one embodiment, the coupling receiver 34 receives a portion of the support frame of the conveying equipment in such a manner that the platform 10 is primarily disposed below the support frame of the conveying equipment. In this manner, the platform 10 may not interfere with the folding of the conveying equipment. This may be useful when the conveying equipment is a gurney that can be moved between folded and unfolded positions such that it can be transported in emergency vehicles, such as ambulances. It will be appreciated, however that the coupling receiver 34 may be placed in any other location on the platform 10 so as to allow the platform 10 to be releasably secured to the conveying equipment. Thus, in other embodiments, the platform 10 may be place in any orientation relative to the patient conveying equipment.

The locking mechanism 44 can comprise any configuration capable of releasably securing the base 12 to the conveying equipment. In one embodiment, the locking mechanism comprises a bolt 45 and nut 47. In other embodiments (not shown) the locking mechanism 44 may comprise a clevis pin having a D-clip or cotter pin. In each of these embodiments, the bolts or clevis pins may extend through apertures 42 and 32. It will be appreciated that apertures 42 may not be necessary in some embodiments. In one alternate embodiment (not shown) the locking mechanism 44 may comprise a member disposed on the leg 36 or top 12 and may be pivotal or otherwise extendable between a locked and an unlocked position. In the unlocked position, a portion of the patient conveying equipment can be moved into or out of the coupling receiver 34. In the locked position, a portion of the patient conveying equipment may be secured in the coupling receiver 34.

The base 12 may further include a platform member locking mechanism generally indicated at 46. The platform member locking mechanism 46 may be used to engage a platform member 80 and inhibit movement thereof. The platform locking member 46 may include a frame generally indicated at 48 retained on the side 18 of the base 12. The frame 48 may comprise any suitable material, including metal, plastic or composite material or combinations. In one embodiment, the frame may comprise a metal material that may be welded to the side 18. It will be appreciated that the frame may be retained on the side 18 in any suitable manner. The frame 48 may include a wall 50. The wall 50 may be spaced from the side 18 and may be generally parallel thereto. The wall 50 may include an aperture 52 therethrough. The aperture 52 may be coaxial with an aperture 54 through the side 18.

A locking member 56 may extend through the apertures 52, 54 and into the cavity 22. The locking member 56 may be made of any suitable material, including metal, plastic or composite material or combinations. In one embodiment, the locking member may have a generally cylindrical shape. The locking member 56 may include a handle. In one embodiment, the handle may comprise a transverse section 58 to create a generally L-shape of locking member 56. It will be appreciated that the handle may take any suitable configuration.

The platform member locking mechanism 46 may further comprise a biasing member 60. In one embodiment the biasing member 60 is a coil spring disposed about the locking member 56. That is, in one embodiment, the locking member 46 may be inserted through the spring 60. The locking member 46 further may include a retainer 62 secured thereon. The retainer 62 may engage the spring 60. In one embodiment, the locking spring 60 may be disposed between the retainer 62 and the wall 18. The spring 60 may be in compression therebetween to bias the locking member 46 into the cavity 22. The retainer 62 may also be used to retain the locking member 46 in the frame 48.

Figure 8:
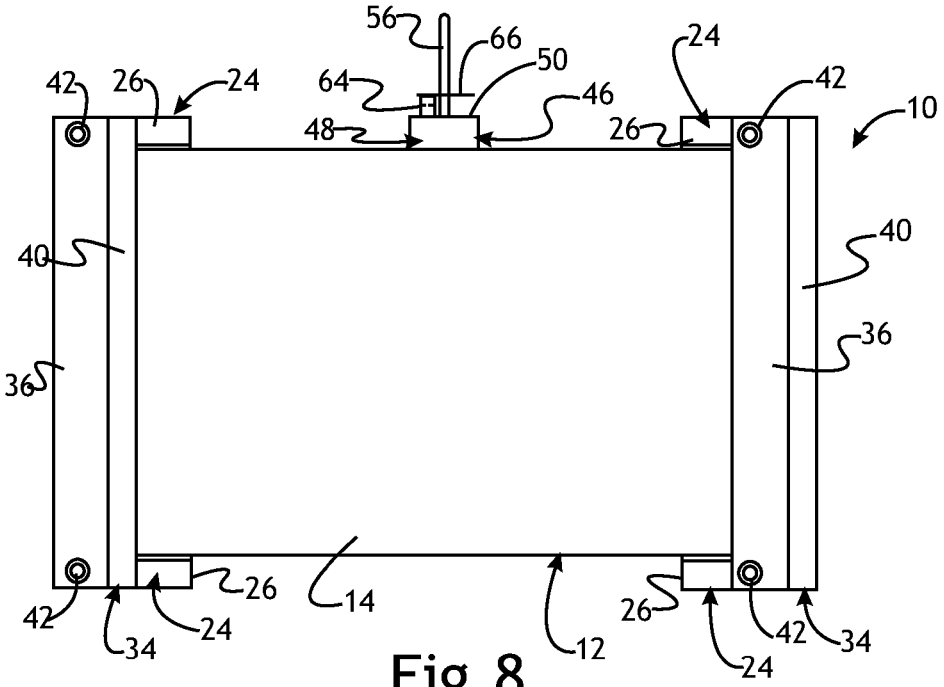
FIG. 8 is a top view of one embodiment of the base.
Figure 9:
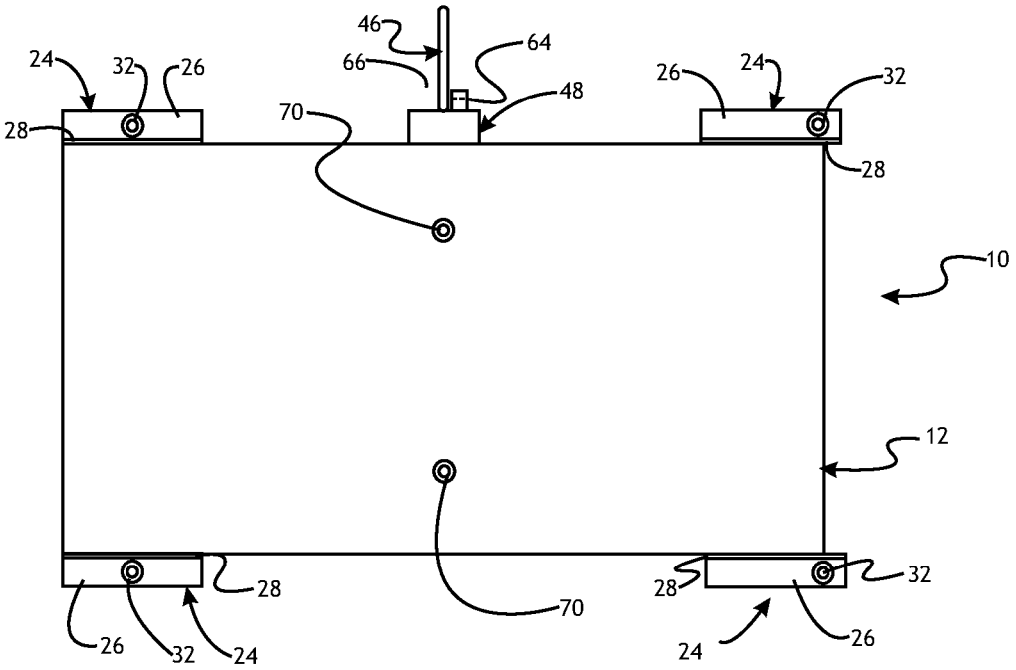
FIG. 9 is a bottom view of one embodiment of the base.

The platform member locking mechanism 46 may further comprise a rest 64 thereon as best seen in FIGS. 8 and 9. The locking member 46 may further include a pin 66 therethrough. The pin 66 may be adapted to engage the rest 64 to maintain the locking member 46 at a position such that it does not extend into the cavity 22 sufficiently to inhibit movement of the platform member 80. More specifically, in one embodiment, the pin 66 may be transversely disposed on the locking member 46. The locking member 46 may be free to rotate in the apertures 52, 54. Thus, the user may rotate the locking member 46 after applying enough force to overcome the biasing of the spring 60 to a position where the pin 66 engages the rest 64. In this manner, the locking member 46 is in a position where it may not extend into the cavity 22 sufficiently to inhibit movement of the platform member 80. The pin 66 may be disengaged from the rest 64 by rotating the locking member 46 sufficient to unseat the pin 66 from the rest 64.

Reference has been made to one embodiment of a platform locking mechanism 46. It will be appreciated that the platform locking mechanism 46 may take any suitable configuration that can be used to selectively allow or selectively inhibit movement of the platform member 80 into and out of the cavity 22.

Figure 6:
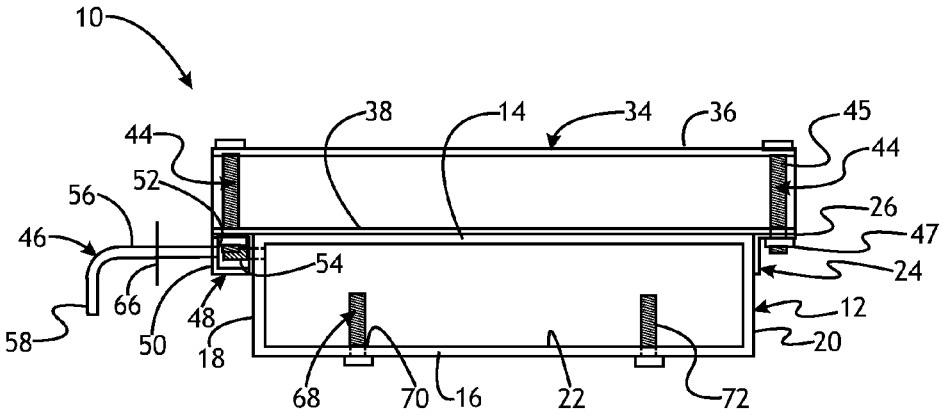
FIG. 6 is an end view of one embodiment of the base.
Figure 7:
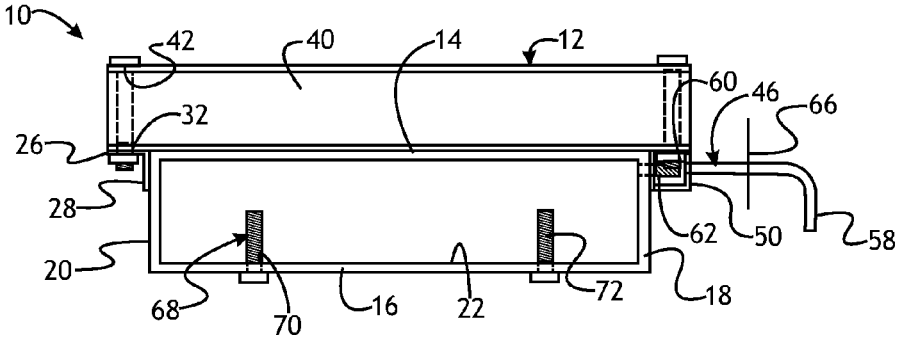
FIG. 7 is an end view of one embodiment of the base.

The base 12 may further include at least one stop generally indicated at 68 as best seen in FIG. 6. The stop 68 may be used to limit movement of the platform member 80 out of the cavity 22. In one embodiment, two stops 68 may be used. Each stop 68 may comprise an aperture 70 through bottom 16 (FIG. 9). The aperture 70 may be threaded. The stop may further comprise a fastener 72 which may be received in aperture 70 and extend into the cavity 22. The fastener 72 may engage a portion of the platform member 80 when the platform member 80 has reached its limit of extension out of the cavity 22. In this way, the stop 68 may be used to prevent the platform member 80 from being extended an undesirable amount during use of the platform 10. Preferably each stop 68 may be positioned so as to limit extension of the platform member 80 out of the cavity 22. In one embodiment, the stops 68 are positioned in line with each other so as to each act on the platform member 80 at the same time. The use of two stops may aid in preventing rotation of the platform member 80.

Reference has been made to one embodiment of a platform stop 68. It will be appreciated that the stop 68 may take any suitable configuration that can be used to limit extension of the platform member 80 out of the cavity 22.

The platform 10 further includes a platform member generally indicated at 80. The platform member 80 may be slideably retained on the base 12 and moveable between a non-extended position and an extended position relative to the base. More specifically in one embodiment the platform member 80 may be slideably retained within the cavity 22. In general, the platform member 80 may be extended from the cavity 22 so as to provide a platform upon which a user, such as emergency medical personnel, may stand to perform procedures on a patient that may be on the conveying equipment 11.

Figure 11:
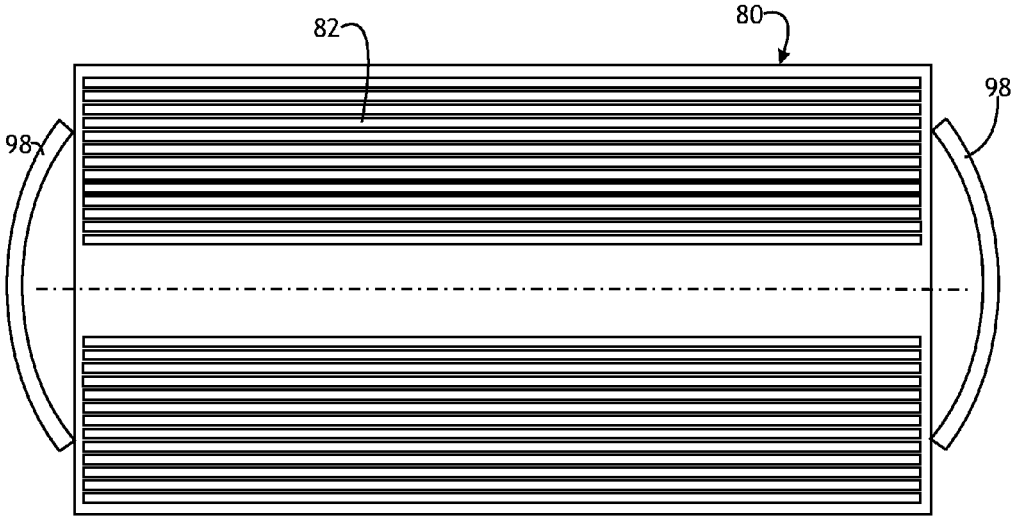
FIG. 11 is a top view of one embodiment of the platform member.

The platform member 80 includes a platform top 82 (FIG. 11). The platform top 82 may comprise a generally rectangular shape. In one embodiment the platform top 82 may have a length and width slightly smaller than the length and width of the cavity 22. In one embodiment, the platform 82 is contained within the cavity 22 when the platform member 80 is not in the extended position. The platform top 82 in one embodiment may include a textured surface thereon so as to provide a more slip resistant surface. However, a textured surface may not be necessary in all embodiments.

Figure 10:
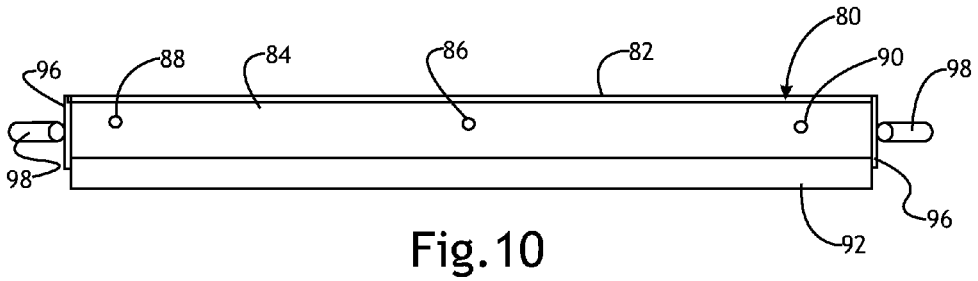
FIG. 10 is a side view of one embodiment of the platform member.
Figure 5:
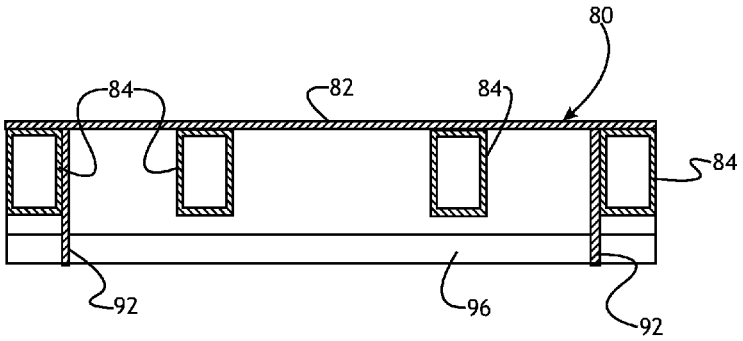
FIG. 5 is a cross-sectional view of one embodiment of the platform member.
Figure 12:
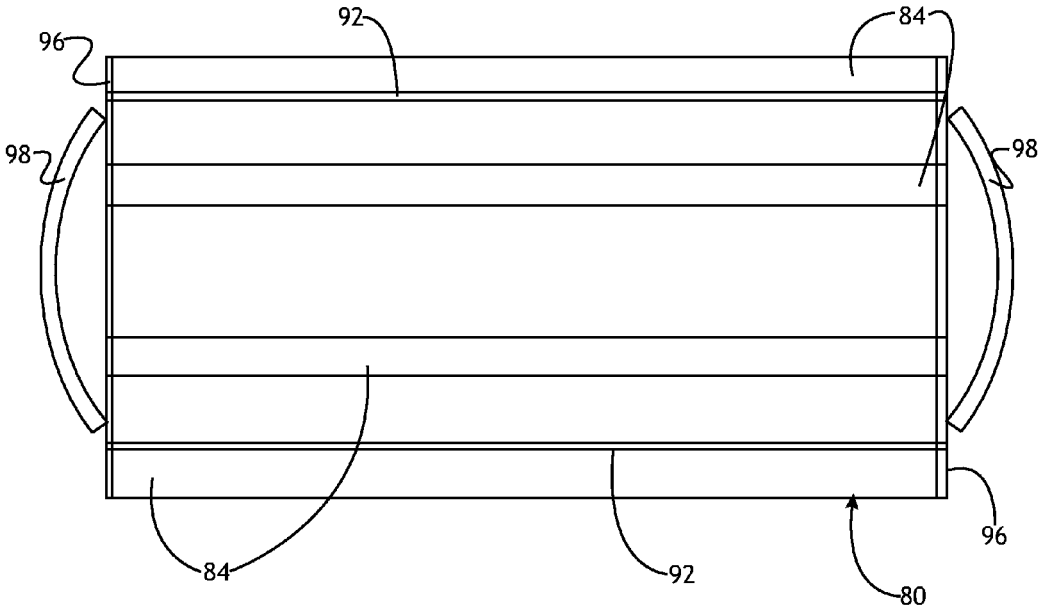
FIG. 12 is a bottom view of one embodiment of the platform member.

The platform member 80 may include at least one support 84 best seen in FIG. 5. In one embodiment four supports are used. The supports 84 depend from the platform top 82 (FIG. 12). The supports 84 may extend the length of the platform top 82 (FIG. 12). The supports 84 may provide structural support to the top 82. One of the supports may include a plurality of apertures 86, 88, 90 therethrough (FIG. 10). These apertures 86, 88 and 90 may receive the locking member 56 as will be further described.

The platform top 82 and supports 84 may comprise any suitable material, including metal, plastic or composite material or combinations. In one embodiment, the platform top 82 may comprise aluminum. Each of the supports 84 may also comprise tubular aluminum in and having a generally rectangular cross-section. In one embodiment, the supports 84 may be welded to the platform top 82. It will be appreciated that in other embodiments, the platform top 82 may have sufficient strength that supports 84 may not be necessary. Alternatively, the platform top 82 and supports 84 may be integrally formed or formed as one piece. It will further be appreciated that the supports 84 may take any suitable configuration. In one embodiment, the supports 84 do not interfere with movement of the platform member 80 into and out of the cavity 22.

Figure 4:
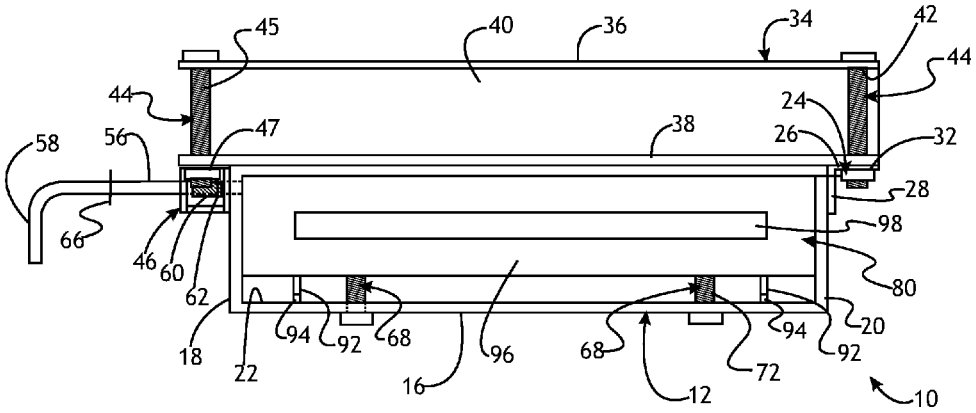
FIG. 4 is an end view of one embodiment.

The platform member 80 may further include at least one runner 92 thereon. The runner may be secured to the platform top 82 or one of the supports 84 or to both. The runner 92 may extend below the support 84 and is adapted to engage the bottom 16 of the base 12 (FIG. 4). The runner 92 may also support the platform top 82 at a predetermined distance above the bottom 16. The runner 92 may extend the length of the platform top 82. In one embodiment, a pair of runners 92 may be used. The runners 92 may be spaced from one another and positioned near the outboard edges of the platform top 82. It will be appreciated, however, that any number of runners 92 may be used and may be positioned in any suitable orientation. The runners 92 may comprise any suitable material, including metal, plastic or composite material or combinations. In one embodiment, the runners 92 may comprise aluminum sheet material that may be secured, such as by welding, to the support 84 and/or platform top 82. It will be appreciated that the runners 92 may be secured in any suitable manner.

In one embodiment, where metal material is used for the runners 92 and bottom 16 of the base 12, it may be desirable to interpose a glide 94 therebetween as best seen in FIG. 4. The glide 94 may comprise a plastic or composite material that may have self lubrication properties. In this way, friction may be reduced between the runners 92 and bottom 16. This may further reduce the noise resulting from the movement of the platform member 80. The glide 94 may be retained on either the bottom 16 or on the runners 68. It will be appreciated that glides 94 may not be necessary. When they are used, they may take any suitable configuration and may comprise any suitable material.

The platform member 80 may further include at least one end wall 96 FIG. 4). The end wall 96 may depend from the platform top 82. In one embodiment, the end wall may extend the width of the platform top 82. The end wall 96 may be secured to the platform top 82, the supports 84 or both. The end wall 96 may, in one embodiment, not extend from the platform top 82 to the bottom of the runner 92. In one embodiment, the end wall only extends a portion of the height of the runner 92. In this way, the end wall 96 is spaced from the bottom 16.

The end wall 96, may, in one embodiment, depend sufficiently from the platform top 82 so as to engage the stops 68 when the platform member 80 is extended from the cavity 22. In one embodiment, two end walls 96 may be placed on opposite ends of the platform top 82 (FIG. 10). The end walls 96 may comprise any suitable material, including metal, plastic or composite material or combinations. In one embodiment, the end walls 96 may comprise aluminum sheet material that may be secured, such as by welding, to the support 84 and/or platform top 82. It will be appreciated that the end walls 96 may be secured in any suitable manner. Each end wall 96 may further include a handle 98 thereon. The handle 98 may comprise any suitable material, including metal, plastic or composite material or combinations and may take any suitable configuration. In one embodiment, the handle 98 may comprise aluminum rod that has been configured in an arcuate shape and welded to the end wall 96. It will be appreciated that the handle may be secured in any suitable manner.

In one embodiment, the platform top 82, supports 84, runners 92 and end walls 96 comprise multiple pieces secured together. It will be appreciated that these components can be made from one piece. In one embodiment the platform top 82, supports 84, runners 92 and end walls 96 may be made as one piece from a suitable plastic or composite material. Similarly, these components may take any desired configuration.

In order to configure the platform 10 for use, the locking member 56 may be pulled away from the cavity 22 and may be rotated until the pin 66 engages the rest 64. In this way, the locking member 56 may be removed from the cavity 22. The platform member 80 may then be inserted into the cavity 22. More specifically, the runners 92 may engage the bottom 12 or any intermediate glide 94 supported therebetween. The handle 98 may then be used to fully insert the platform member 80 into the cavity 22. Once the platform member 80 is inserted into the cavity 22, the locking member 56 may then be rotated to unseat the pin 66 from the rest 64. The spring 60 may then bias the locking member 56 toward the cavity 22 such that locking member may be inserted through the aperture 54 in the side 18 and the aperture 86 in the support 84. Once the platform member 80 has been inserted, the stops 68 may be inserted by threading the fasteners 72 into apertures 70.

When the stops 68 have been inserted, the platform 10 may be secured to conveying equipment. In one embodiment, the platform 10 is placed intermediate the front or rear legs of the conveying equipment. The platform 10 may be retained on the generally horizontal support structure of the conveying equipment by placing the horizontal support structure on opposite sides of the equipment into the coupling receivers 34. The locking mechanism 44 may then be inserted through the apertures 42, 32 to thereby releasably retain the platform 10 on the conveying equipment. In one embodiment, the platform 10 is positioned below the support structure so as to not interfere with folding movement of the conveying equipment.

When the platform 10 is connected to the conveying equipment, the platform member 80 may be moved between an extended or use position and a non-extended or stowed position. In one embodiment, the platform member 80 may be extended from either end of the cavity 22 and therefore has an extended position in two directions. That is, the platform member 80 can extend outwardly from the cavity to either side of the conveying equipment. One extended position is shown in FIG. 1 in solid lines and the extended position in the opposite direction is shown in dashed lines.

In order to extend the platform member 80 from the cavity 22, the locking member 56 may be pulled away from the cavity 22. The locking member 56 may be rotated until the pin 66 engages the rest 64. Alternatively, the user, typically emergency medical personnel, can simply hold the locking member 56 in place. The user can then move the platform member 80 in the desired direction by grasping the appropriate handle and exerting an extension force on the platform member 80. The force is exerted until the platform member 80 moves sufficiently such that the end wall 96 engages the stops 68, in one embodiment, the fastener 72. When the platform member 80 is moved to the extended position shown in solid lines in FIG. 1, the locking member 56 may be rotated and released or simply released until the locking member extends through the aperture 88. In this manner, the platform member 80 may be secured in the extended position. If the platform member 80 is moved to the extended position shown in dashed lines in FIG. 1, the locking member may be disposed through aperture 90 to retain the platform member in the extended position. It will be appreciated that apertures 86, 88, 90 may not be necessary. The platform locking mechanism 46, and particularly the spring 60, may exert sufficient force on the locking member 56 such that the locking member 56 will directly engage the support 84. The force from the spring 60 may be such that a force is applied by the locking member 56 directly on the support 84 to retain the platform member 80 in the desired position.

Once the platform member 80 is in the extended position, a user of the platform 10 may stand on the platform member 80. This may be advantageous when the user is a medical service provider that needs to perform procedures on a patient. More specifically, medical service provider can ride on the platform while the conveying equipment is being used, without having to move beside the conveying equipment himself or herself. Thus, while the conveying equipment having the patient thereon is being move, the medical service provider remains in the same position relative to the patient. This may be advantageous in emergency situations when patients need to be conveyed from remote sites to emergency vehicles while procedures need to be simultaneously performed. The medical service provider may also wear a safety harness or strap that can be secured to the conveying equipment to help maintain the medical service provider on the platform member 80 during use.

Additionally, some medical procedures require advantageous positioning of the medical service provider relative to the patient. By standing on the platform member 80, the medical service provider's height is increased relative to the patient. In some instances this may be advantageous. Further the platform 10 allows the medical service provider with the ability to extend the platform member 80 on either side of the patient.

When the conveying equipment has reached its destination, for example an ambulance, the user can simply step off the platform member 80, pull the locking member 56 and move the platform member 80 back into the cavity 22. The locking member 56 can be released to secure the platform member 80 in the cavity. The conveying equipment can be folded in the normal manner without interference from the platform 10. Further, if for any reason the platform needs to be removed from the conveying equipment, the user simply releases the locking mechanisms 44 and removes the platform by disengaging the conveying equipment support structure from the coupling receivers 34.

When retained on the conveying equipment, the platform 10 may also comprise a surface that can support equipment. More specifically, the top 14 may be used to support equipment such as medical equipment that can be transported on the top 14. The platform 10 may further include additional structure for this function. In one embodiment, netting or the like (not shown) may be included on one or more sides of the platform 10 and can be extendable to engage the support structure of the conveying equipment. In this way, the ability to carry additional equipment may be enhanced.

Figure 2:
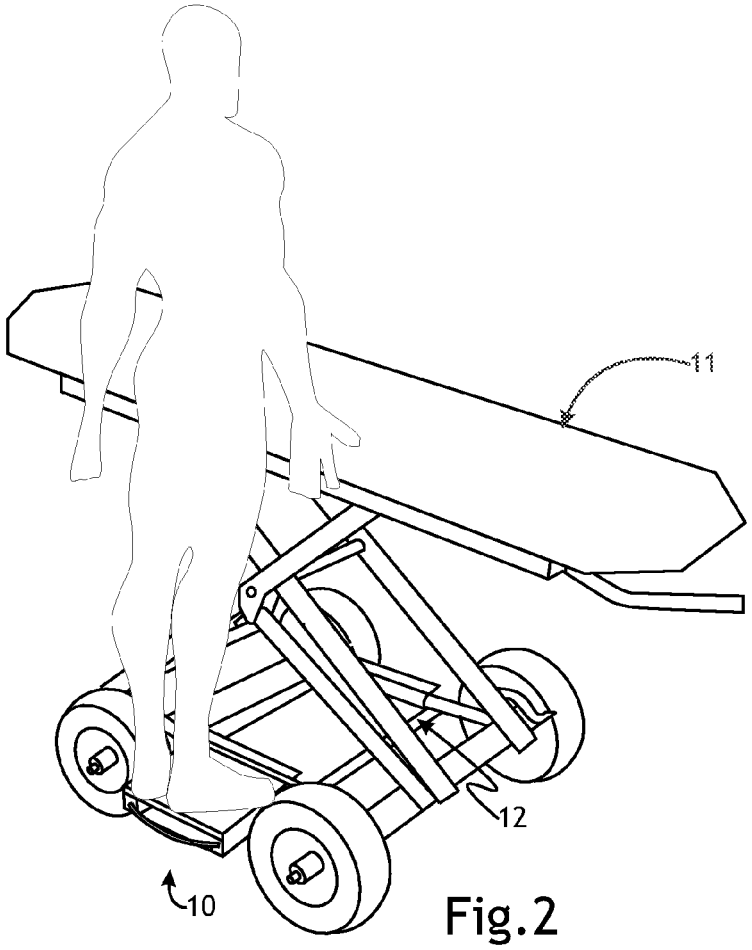
FIG. 2 is a schematic view of one embodiment showing conveying equipment.
Figure 3:
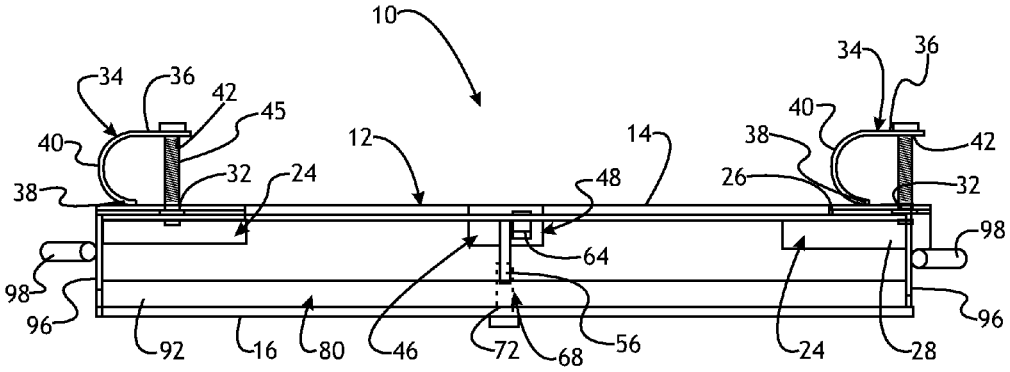
FIG. 3 is a side view of one embodiment also showing the platform member.

The platform 10 may also be useful in conjunction with an enhanced mobility device for conveying equipment as shown in FIG. 2. Such a device is described in my patent application Ser. No. 61/315,831 filed Mar. 19, 2010, which disclosure is incorporated herein by reference.

The device has been described as having many parts that may be secured together. It will be appreciated that any of the components described herein may be combined and integrally formed as one piece. Additionally some of the components may be eliminated in certain embodiments.

Additionally, only one embodiment of the platform member 80 is described. It will be appreciated that the platform member 80 may be disposed in the cavity 22 in any suitable manner that allows the platform member 80 to move between extended and non-extended positions. By way of non-limiting example, the platform member 80 may be supported in the cavity as a conventional drawer. In such embodiments, the runners 92 may not be necessary.

The foregoing description is considered illustrative only of the principles of the invention. The terminology that is used is intended to be in the nature of words of description rather than of limitation. Furthermore, because numerous modifications and changes will readily occur to those skilled in the art, it is not desired to limit the invention to the exact construction and process shown as described above. Accordingly, all suitable modifications and equivalents that may be resorted to fall within the scope of the invention as defined by the claims that follow.

What is claimed is:

1. An assembly comprising:

a gurney having a support structure, the support structure having connected thereto a pair of spaced apart front wheels at a front end of the support structure and a pair of spaced apart rear wheels at a rear end of the support structure, each of the front wheels and the rear wheels support the support structure;

a platform comprising:

a base comprising a top and bottom defining a cavity having a first end and a second end; a coupling receiver disposed on said base capable of receiving at least a portion of the support structure of the gurney to releasably retain the base on the gurney:

a platform member slideably retained on said base and moveable axially out of said base between a non-extended position and a first extended position in a first direction out of the first end of the cavity and on a first side of the gurney and moveable between a non-extended position and a second extended position in a second direction out of the second end of the cavity and on a second side of gurney, the platform member having a free end when in the first or second extended position, the free end of the platform member extending from the base in cantilevered fashion, and the platform member constructed to support a human when standing on the platform member when the platform member is in the first or the second extended position.

2. The assembly as set forth in claim 1 further comprising a stop on the base to limit axial movement of the platform member relative to the base.

3. The assembly as set forth in claim 1 wherein the platform member includes an end wall having a handle thereon.

4. The assembly as set forth in claim 1 wherein the platform member includes a runner engaging the base.

5. The assembly as set forth in claim 1 further comprising a platform member locking mechanism, the platform member locking mechanism selectively engageable with the platform member.

6. The assembly as set forth in claim 1 wherein the coupling receiver comprises a generally c-shaped member adapted to receive at least a portion of the support structure of the gurney.

7. The assembly as set forth in claim 6 wherein the c-shaped member includes a pair of spaced legs connected by an arcuate portion, at least one of the legs extending a distance from the arcuate portion greater than the other leg.

8. The platform as set forth in claim 6 further comprising a locking mechanism on the coupling receiver, the locking mechanism moveable between locked and unlocked positions.

9. The assembly as set forth in claim 8 further comprising a mounting flange on the base, the locking mechanism on the coupling receiver selectively engaging the mounting flange on the base.

10. A platform adapted to be attached to a gurney having a support structure, the support structure having connected thereto a pair of spaced apart front wheels at a front end of the support structure and a pair of spaced apart rear wheels at a rear end of the support structure, each of the front wheels and the rear wheels support the support structure, the platform comprising:

a base comprising a top and bottom and defining a cavity having first and second ends, the bottom including a stop;

a platform member disposed in the cavity and moveable axially out of said base between a non-extended position and a first extended position out of the first end of the cavity and on a first side of the gurney, and moveable between a non-extended position and a second extended position out of the second end of the cavity and on a second side of the gurney, the platform member having a free end when in the first or second extended position, the free end of the platform member extending from the base in cantilevered fashion, the stop limiting axial movement of the platform member, the platform member constructed to support a human when standing on the platform member when the platform member is in either of the first extended position or the second extended position to thereby allow the human standing on the platform to be transported along with a patient on the gurney;

a platform member locking mechanism selectively engageable with the platform member; and a coupling receiver disposed on the base and capable of receiving at least a portion of the support structure of the gurney to releasably retain the base on the support structure of the gurney.

11. A platform as set forth in claim 10 wherein the platform member comprises a platform top and a runner extending from the platform top and engaging the bottom of the base.

12. A platform as set forth in claim 10 wherein the platform member includes an end wall having a handle thereon.

13. A platform as set forth in claim 10 wherein the coupling receiver comprises a generally c-shaped member adapted to receive at least a portion of the support structure of the gurney.

14. A platform as set forth in claim 13 wherein the c-shaped member includes a pair of spaced legs connected by an arcuate portion, at least one of the legs extending a distance from the arcuate portion greater than the other leg.

15. A platform as set forth in claim 13 further comprising a locking mechanism on the coupling receiver, the locking mechanism moveable between locked and unlocked positions.

16. A platform as set forth in claim 15 further comprising a mounting flange on the base, the locking mechanism on the coupling receiver selectively engaging the mounting flange on the base.

* * * * *